US005683090A

United States Patent [19]

Zeile et al.

[11] Patent Number: 5,683,090

[45] Date of Patent: Nov. 4, 1997

[54] SPORTS CHANCE GAME APPARATUS AND METHOD OF PLAYING SAME

[76] Inventors: Kim A. Zeile, 6914 W. Church, Clarkston, Mich. 48309; Ellen L. Fleming, 400 N. Hunter Blvd., Apt. 305, Birmingham, Mich. 48009

[21] Appl. No.: 483,338

[22] Filed: Jun. 7, 1995

[51] Int. Cl.[6] ..... A63F 9/00; A63F 3/06

[52] U.S. Cl. ..... 273/269; 273/236; 273/139; 463/16; 463/19; 463/40; 463/22

[58] Field of Search ..... 463/16–19, 1, 463/40–42, 29, 43, 25; 364/410, 412; 273/237, 247, 274, 293, 139; 283/49, 903

[56] References Cited

U.S. PATENT DOCUMENTS

| | | | |
|---|---|---|---|
| 4,087,092 | 5/1978 | Krause | 463/17 |
| 4,108,361 | 8/1978 | Krause | 364/412 |
| 4,141,548 | 2/1979 | Everton . | |
| 4,429,877 | 2/1984 | Coppock . | |
| 4,508,513 | 4/1985 | Donovan | 273/139 |
| 4,540,174 | 9/1985 | Coppock | 463/16 |
| 4,592,546 | 6/1986 | Fascenda et al. | 463/40 |
| 4,722,526 | 2/1988 | Tovar et al. | 463/40 |
| 4,842,278 | 6/1989 | Markowicz | 364/412 |
| 4,882,688 | 11/1989 | Kondziolka et al. | 273/269 |
| 4,883,636 | 11/1989 | Fantle, Jr. | 273/269 |
| 4,885,700 | 12/1989 | Kondziolka et al. | 273/269 |
| 4,953,873 | 9/1990 | Jacobson | 273/274 |
| 5,007,649 | 4/1991 | Richardson | 263/269 |
| 5,018,736 | 5/1991 | Pearson et al. | 463/31 |
| 5,034,807 | 7/1991 | Von Kohorn | 455/2 |
| 5,035,422 | 7/1991 | Berman | 463/41 |
| 5,043,887 | 8/1991 | Richardson et al. | 263/269 |
| 5,043,889 | 8/1991 | Lucey | 463/18 |
| 5,072,381 | 12/1991 | Richardson et al. | 263/269 |
| 5,096,202 | 3/1992 | Hesland | 273/269 |
| 5,156,397 | 10/1992 | Valenza, Jr. | 463/16 |
| 5,263,723 | 11/1993 | Pearson et al. | 463/40 |
| 5,283,734 | 2/1994 | Von Kohorn | 463/40 |
| 5,332,218 | 7/1994 | Lucey | 273/139 |
| 5,351,970 | 10/1994 | Fioretti | 463/40 |
| 5,462,275 | 10/1995 | Lowe et al. | 364/410 |
| 5,499,816 | 3/1996 | Levy | 273/139 |
| 5,508,731 | 4/1996 | Von Kohorn | 455/5.1 |

*Primary Examiner*—Jessica Harrison
*Assistant Examiner*—Mark A. Sager
*Attorney, Agent, or Firm*—Young & Basile, PC

[57] ABSTRACT

An apparatus and method for playing a sports chance game includes means for storing team names, players on each team, and a first group of occurrences which could happen during a sports event contested by the two teams. A processor randomly selects a second group of occurrences from the first group of occurrences and randomly arranges each of the second group of possible occurrences into individual locations on a patterned layout on a scorecard for a verified user of the game. The processor determines matches between the second group of possible occurrences on each scorecard with events which actually occurred at the sports event and determines a winning scorecard based on a certain number of matches and/or the location of the matches on each scorecard.

23 Claims, 8 Drawing Sheets

SPORTS CHANCE GAME APPARATUS AND METHOD OF PLAYING SAME

BACKGROUND OF THE INVENTION

1. Field of the Invention

The present invention relates, in general, to games and specifically, to games whose play and outcome is based on a sporting event or contest.

2. Background Description

Attending a sports event and/or viewing or listening to sports events or game is a popular activity for wide segments of society. While betting on the outcome of a sports game is illegal in most states, various sports teams or arenas have used contests during a game in which individuals in certain seats or sections of the arena or having a particular ticket number are awarded prizes in a random drawing or upon the occurrence of a particular event during the game.

Board games have also been devised which determine a winner based on the successful prediction of event occurrences during a sports contest, such as a certain length run or pass in football or a total team score at the end of a game or at the end of certain periods, quarters or innings of a sports game.

While such drawings or contests add to customer enjoyment of a sports event, such contests are short lived since they are usually triggered by a single drawing or upon the occurrence of a single selected event during the sports game. In games which are not evenly contested, such as where one team scores considerably more than the other team, fan interest wans and large numbers of fans frequently leave the arena early before the end of the game. This decreases the sales of food, beverages and souvenirs as well as lowering overall fan interest in the game due to the absence of large numbers of fans while the game is still being contested.

Thus, it would be desirable to provide a sports chance game which is playable during an actual sports event which increases fan interest in the outcome of the sports event, encourages fans to remain in arenas and stadiums throughout the entire sports event, or encourages fans to observe or listen to a television or radio broadcast of the entire sports event, and increases fan interest by awarding prizes to winners of the game. It would also be desirable to provide a sports chance game playable during an actual sports event which is easy to play and is adaptable for use with various sports, in one or more arenas or stadiums, as well as lending itself to play over interactive communication networks. It would also be desirable to provide a sports chance game useable in different sports without significant modifications. Finally, it would be desirable to provide a sports chance game playable during an actual sports event in which a winner is quickly determined so that the winner may collect any awarded prizes immediately.

SUMMARY OF THE INVENTION

The present invention is an apparatus and method for playing a sports chance game which is based on events actually occurring during a sports event contested by two teams.

The apparatus includes memory means for storing a control program and data representing the names of two teams contesting a sports event, the names of the players on the two teams and a first group of a plurality of different events which can occur at the sports event between the two teams. A processor means executes the control program stored in the memory means and is responsive to the data in the memory means for randomly selecting a second group of a plurality of events from the first group of events which could occur at the sports event between the two teams. The processor means randomly arranges each of the plurality of events in the second group of events in one location on a scorecard having a patterned arrangement of a plurality of individual locations. Means are provided for verifying a user to obtain a scorecard. Means are provided for inputting to the processor means actual event occurrences at the sports event. The processor means is responsive to the inputting means for determining matches between the second group of possible occurrences on each scorecard with actual event occurrences at the sporting event and determines a winning scorecard according to defined rules.

In a preferred embodiment, the means for verifying a user includes terminal means having means for receiving and determining the amount of currency input by a user. A plurality of individual terminal means may be remotely located throughout an arena and connected in data communication with the processor means. Further, terminals may be located remotely from the arena and still connected in data communication with the processor means.

Means are also provided for inputting the roster of players on the two teams contesting a particular sports event who could actually play in the sports event. The roster of player names is used by the processor means to randomly generate the second group of possible occurrences by the teams and the starting players on the two teams at the sports event. Such starting player information may be input to the processor means from an event entry terminal located in the arena in which the sports event between the two teams will be contested. The user verifying terminal means also includes means, responsive to the processor means, for printing a scorecard for each verified user. Alternately, the scorecard may be visually displayed on a monitor with the processor means automatically determining matches for winning/non-winning scorecards at the conclusion of the sports event.

Each scorecard pattern of individual locations which receive one of the second group of possible occurrences at the sports event may be provided in any number of different pattern layouts. In one embodiment, the scorecard is a physical card having an n×n grid (i.e., five×five) arrangement of locations each having a generally square shape. In this embodiment, a winning scorecard is determined by five matches on the scorecard arranged in one of a horizontal, vertical or diagonal row.

Alternately, points may be assigned to each location on a scorecard with the total accumulated points of all matches on a scorecard which exceed a predetermined value being used to determine a winning scorecard.

In a broader sense, the apparatus and method are usable with an entire sports league formed of a plurality of teams playing each other at set dates and locations according to an established schedule. Further, teams in multiple leagues in different sports may also be programmed into a centrally located processor means which communicate with event entry terminals and site terminals at each arena.

The method of playing a sports chance game according to the present invention comprises the steps of:

a) selecting two teams who are competing in a sports event, each team having a plurality of players;

b) establishing a first set of possible occurrences which can occur at the sports event between the two teams;

c) verifying a user to play the game;

d) upon verifying a user, randomly selecting a second set of occurrences from the first set of occurrences, the second set of occurrences containing fewer occurrences than a total number of occurrences in the first set;

e) establishing a layout having a plurality of individual locations adapted for association with one of the second set of occurrences;

f) randomly assigning each of the second set of occurrences to one of the individual locations on the layout;

g) determining the actual occurrences at the sports event;

h) verifying a winning layout which has one of a predetermined number of matches and a predetermined number of matches arranged in a defined pattern on the layout wherein a match is determined by one of the second set of occurrences matching one of the actual occurrences at the sports event.

The method further includes the steps of tabulating statistics for each player on each of the two teams from previous sports events played by each player. The statistical information is then used to increase the probability that certain of the second set of occurrences by certain players on each team will be selected for the second group of occurrences based on the individual player statistics.

The possible occurrences which can occur during a sports event and which are used to form the second group of occurrences include at least some of scores under the rules of the sporting event by individual players on each team and by each team as well as penalties accorded each player or each team during the sports event.

The sports chance game apparatus and method of the present invention provides a convenient way to increase fan interest in a sports event by awarding prizes to fans playing the game based on events which actually occur at a sports event. The apparatus and method is easy to use and can be easily modified to increase or decrease the number of winners. Further, the apparatus and method can be provided in different forms for use in a single arena, for use by one entire sports league formed of a plurality of teams playing each other in an established schedule at different arenas, and with multiple leagues, each formed of different teams.

BRIEF DESCRIPTION OF THE DRAWING

The various features, advantages and other uses of the present invention will become more apparent by referring to the following drawings in which.

DESCRIPTION OF THE PREFERRED EMBODIMENTS

Figure 1:
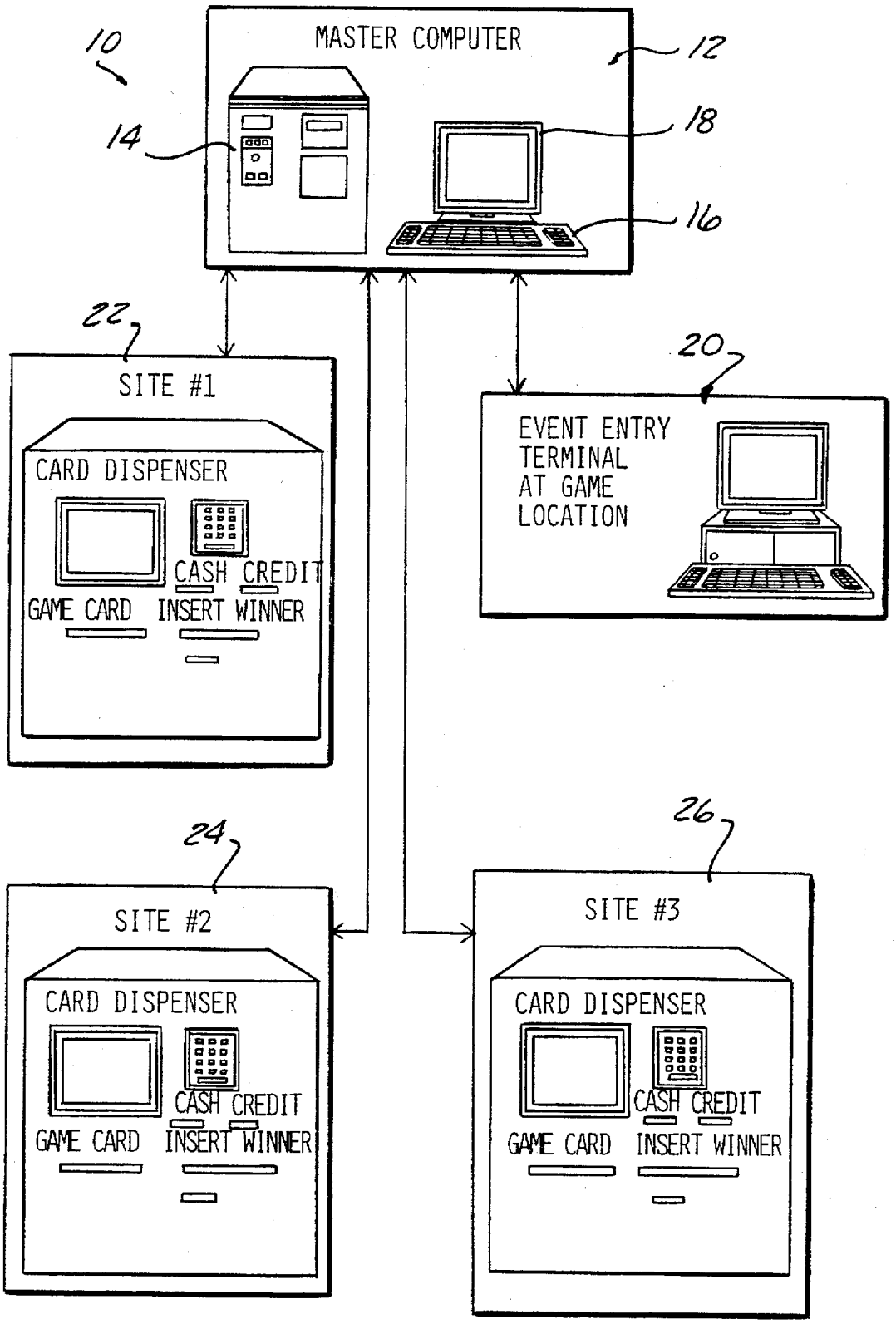
FIG. 1 is a pictorial representation of a sports chance game apparatus constructed in accordance with the teachings of the present invention.

Referring now to the drawing, and to FIG. 1 in particular, there is depicted an exemplary embodiment of a sports chance game apparatus 10 which provides a method for playing a sports chance game during an actual sports event contested by two organized sports teams.

The apparatus 10 includes a master computer system 12 preferably formed of a main central processing unit (CPU) 14 which may take the form of any suitable processor, such as those employed in personal computers, computer workstations, or mainframe-type computers. The CPU 14 communicates with a data entry keyboard 16 and a display monitor 18. The CPU 14 also includes memory which stores a control program for controlling the operation of the apparatus 10 as well as the various databases described in detail hereafter.

The apparatus 10 also includes an event entry terminal 20 which is preferably located directly at a sports event or game location, such as in an arena, stadium, etc. The event entry terminal 10 is, by way of example only, in the form of a personal computer containing its own CPU and memory as well as a data input keyboard and a display monitor.

At least one and preferably a plurality of remote site locations, labelled site #1 denoted by reference number 22, site #2 denoted by reference number 24 and site #3 denoted by reference number 26, etc., are connected in data communication with the master computer 12 by means of any conventional data communication system, including hard wires, satellite communication, etc. Further, each individual site terminal, such as site terminals 22, 24 and 26, may be distributed at various locations in the arena in which the event entry terminal 20 is located and/or at other locations remote from or outside of the arena.

Each site terminal, such as site terminal #1 denoted by reference number 22, could be in the form of an automatic teller type machine which has an internal central processing unit and memory containing a control program for operating the site terminal. A display is mounted on the housing of the site terminal 22 along with an input keypad and various slots for receiving cash or a credit card dispensing a game card, as well as receiving an actual game card for determination if the game card is a "winner". An optical scanner may be mounted within the site terminal 22 for optically scanning a game card inserted through the "Insert winner" slot for processing by the master computer 12 as described hereafter.

In one exemplary arrangement, the master computer 12, the event entry terminal 20 and one site terminal, such as site terminal 22, may be integrated into a single unit located in one arena or stadium for use at one location in the arena or stadium. Alternately, the master computer 12 and event entry terminal 20 may be integrated into a single unit and connected to a plurality of remotely located site terminals, such as site terminals 22, 24 and 26, which are also located throughout in the same arena or stadium where the integrated master computer 12 and event entry terminal 20 are located.

However, the sports chance game apparatus 10 can be advantageously devised for use in all arenas or stadiums in which a plurality of sports teams organized into a league play a predetermined schedule of events involving two teams at a time at a predetermined date and time in various predetermined arenas or stadiums throughout one or more countries. Thus, the game apparatus 10 could be used with professional baseball, basketball, hockey and football leagues as well as various college level and amateur sports leagues of all types. Further, while the game apparatus 10 may be set up for use in conjunction with only one particular sports league, such as hockey, for example, the apparatus 10 may also be configured for use in playing the sports chance game of the present invention in conjunction with several different sports involving different leagues, teams and sports events. Thus, the game apparatus 10 could be configured for use in playing the sports chance game of the present invention at all sports events involving organized baseball, basketball, hockey and football.

In such an overall arrangement, the master computer 12 of the game apparatus 10 may be located at a single central location which may be associated, for example, with a particular league headquarters, one of the arenas in which one of the teams in a particular league plays its home sports event, or at any other convenient location which lends itself to long distance data communications.

Such data communication may employ any conventional data communication system including dedicated hard wires or cables, satellite uplink communication systems, microwave communication systems as well as interactive cable or television systems as will be described in greater detail hereafter.

In such an overall, multi-league, multi-arena arrangement, an event entry terminal 20 is physically located in each arena or stadium at which one team in the specified leagues plays its home sports games or events. Thus, one event entry terminal 20 is located in the arena or stadium for each team in a league and, where multiple leagues are programmed into the master computer 12, at each arena or stadium of each of the teams in all of the specified leagues.

Further, each arena or league will contain at least one and preferably a plurality of remotely located site terminals, such as site terminals 22, 24 and 26, which are disbursed throughout each arena or stadium. Although such site terminals are depicted in FIG. 1 as individually communicating with the master computer 12, a dedicated communication controller, which may be separate from or integrated with the event entry terminal 20 in a particular arena or stadium, may be provided at each arena or stadium for controlling data communication between the master computer 12 and all of the site terminals 22, 24, 26, etc., in a particular arena or stadium.

It will also be understood that in addition to the various data communication systems described above, the sports chance game apparatus 10 of the present invention may also be played over an interactive television system which may utilize the well known Internet communication system. In such an interactive system, rather than individually dispensing a hard copy scorecard from each remote site terminal at a particular arena or stadium, the game apparatus 10 can generate and display on each remote monitor or television a scorecard for a particular player. This individual display can be called up by a particular player, after initial verification described hereafter, at any time during a sports event and the appropriate matches, as also described hereafter, can be highlighted or otherwise indicated directly on the television or monitor. A winning card containing a predetermined number or arrangement of matches can also be determined automatically by the game apparatus at the conclusion of the specific sports event and appropriate prizes awarded to a winning player delivered to the winning player.

Figure 2:
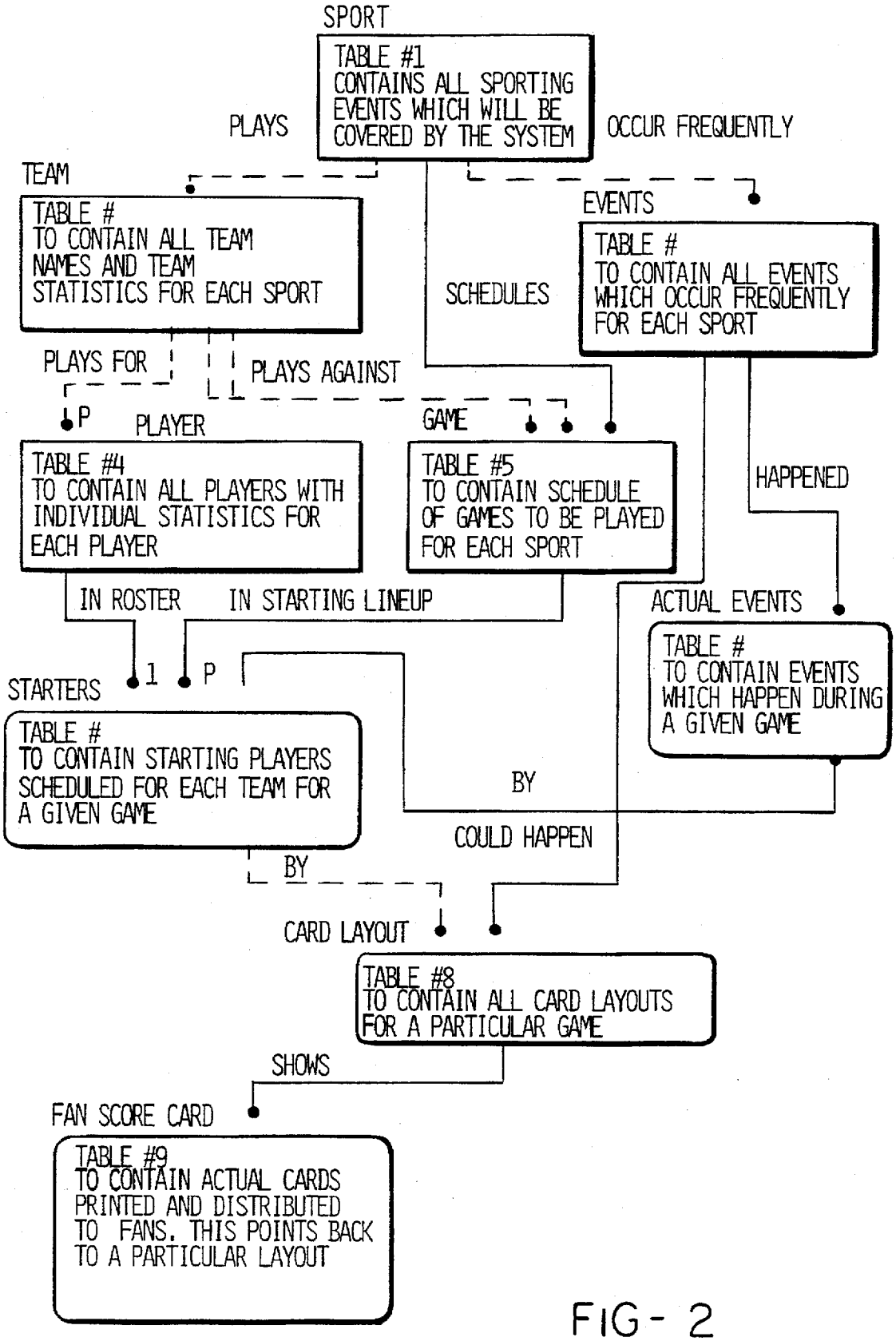
FIG. 2 is a flow diagram depicting the database setup and method of operation of the sports chance game of the present invention.

Turning now to FIG. 2, there is depicted a flow diagram depicting the arrangement and data communication or data flow between the various tables of a database which is stored in the memory of the computer 14 of the master computer 12. The flow chart shown in FIG. 2 is devised for using the game apparatus 10 for multiple leagues of organized sports teams playing different sports events at various times throughout the year according to separate schedules for each league. Further, it will be understood that the game apparatus 10 is capable of operation in playing multiple sports chance games for different sports leagues at the same time even though the following description is provided for clarity only for a single league playing a predetermined schedule of events between a set number of teams forming the league. It will also be understood that the game apparatus 10 may be easily employed in only a single arena or stadium involving one team in an organized sports league which plays various other teams in the league in a set schedule at a specific arena.

The various tables shown in FIG. 2 comprise individual tables of data or databases which are programmed into and stored in the memory of the computer 14 of the master computer 12. Table #1 contains data representing all of the sports events in which the sports chance game apparatus 10 of the present invention is to be used. Thus, table #1 can include data for one or more organized sports leagues, including any or all of baseball, basketball, hockey and football leagues, for example.

Table #2 is related to table #1 and contains data representing all of the various events or occurrences which frequently occur for each sport specified in table #1. In the exemplary use of the game apparatus 10 for hockey, table #2 will contain data specifying goals, assists, shutouts, various penalties, etc., by a team and by individual players A skilled artisan will easily appreciate that table #2 can also be programmed with data representing similar events which frequently occur in other sports, such as baseball, basketball and football.

Table #3 is a list of individual team names and/or team statistics for each sport specified in table #1. As such, table #3 will contain a list of individual team names, such as team A, team B, team C, etc., as well as the more common statistics reported for each team in each particular sport. These statistics are updated on a game-by-game basis by input to the master computer 12.

Table #4 contains data representing the names of all of the players on each of the teams specified in table #3 as well as several individual statistics for each player. Thus, table #4 will include a list of players, such as player no. 1, player no. 2, etc., for each team specified in table #3 as well as any number of individual statistics for each specified player. The individual statistics as well as the names of the players on each team will be updated on a game by game basis or as needed as players are added or removed from any team or traded between teams.

Table #5 contains the schedule of games to be played for each sports league specified in table #1. Thus, for each league, table #5 contains the dates, starting time, location and the two teams scheduled to play each sporting event throughout the entire league season.

Table #6 contains data representing a roster of names of players on each team which could play in a particular scheduled event. The roster names can differ from the player names in table #4 due to player injury, suspension, etc., which prevent certain players from playing in a particular sports event. Table #6 is related to tables #4 and #5 and requires input through the event entry terminal 20 at the arena where a scheduled game or event is to be played. The roster of available players is input as soon as such information becomes available according to specified league rules or a set time, such as one day or even several hours before the starting time of a particular sports event.

Table #7 includes data representing the events which actually occur during the specified sports event. These actual occurrences, such as a particular scoring event, who scored, the time of scoring, who and what type of penalty occurred, total team scores by individual period and total game, etc., are input through the event entry terminal 20 at the specified arena preferably throughout the game or, at the least, immediately after the conclusion of the sports event. Such information is readily available from the official league scorer at each game or sports event.

Table #8 contains all of the possible scorecard or layouts for a particular scheduled sports event. This table is generated in conjunction with the card generation routine described hereafter and shown in FIG. 6 and is based on the starting players and other factors to be described hereafter.

Finally, table #9 contains data representing all of the individual event possibilities chosen for each of the actual scorecards generated and distributed or provided by the game apparatus 10 during a particular sports event. Each distributed card and the group of data associated with each card can be identified by a discrete code, such as a conventional bar code unique to each card. This simplifies the determination of a winning card as described hereafter.

Figure 3:
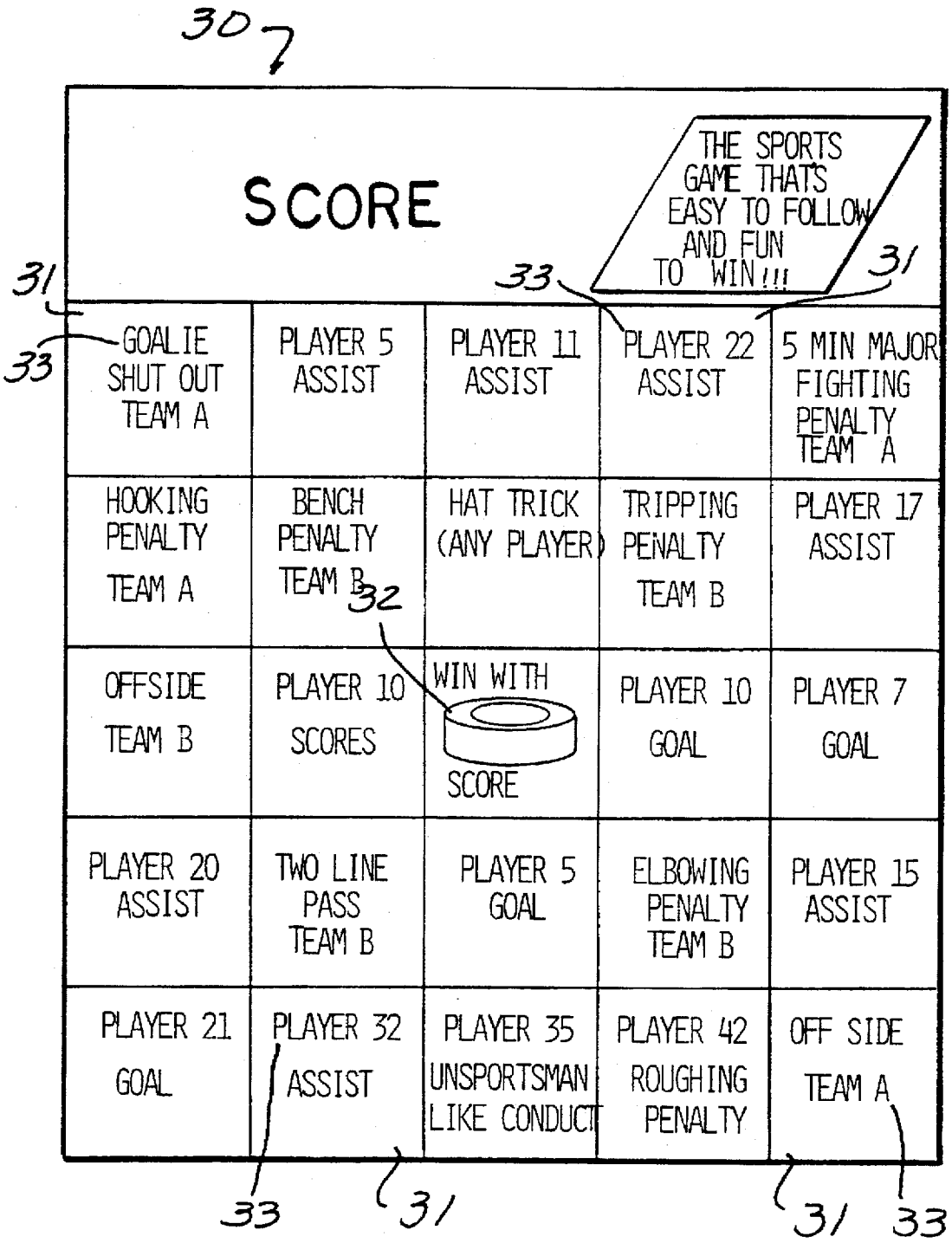
FIG. 3 is an example of a game card generated by the apparatus of the present invention.

In one embodiment, the game apparatus 10 is designed to generate a physical printed scorecard 30 shown in FIG. 3 by any of the site terminals 22, 24, 26, etc. Alternately, it will be understood that the scorecard 30 can be replaced by a monitor display containing the same grid or design arrangement as shown in FIG. 3.

By way of example only, the scorecard 30 includes a plurality of discrete locations 31 illustrated as being in the form of a five×five grid of adjoining locations 31 or squares arranged in horizontal and vertical rows in much the same manner as a conventional bingo card. The centermost square 32 is designated a free square and may be employed to depict various promotional information. Each location 31 receives one event possibility 33 selected by the game apparatus 10.

It will be understood that the scorecard 30 may also be generated in other forms having any desired shape, such as a star, diamond, pentagon, ring-like shape, etc. Such shapes may also be sport specific, such as a overall football shape when the scorecard is used for a football event, a basketball for a basketball event, etc. The number and shape of the location 31 can also be varied for scorecards 30.

Figure 4:
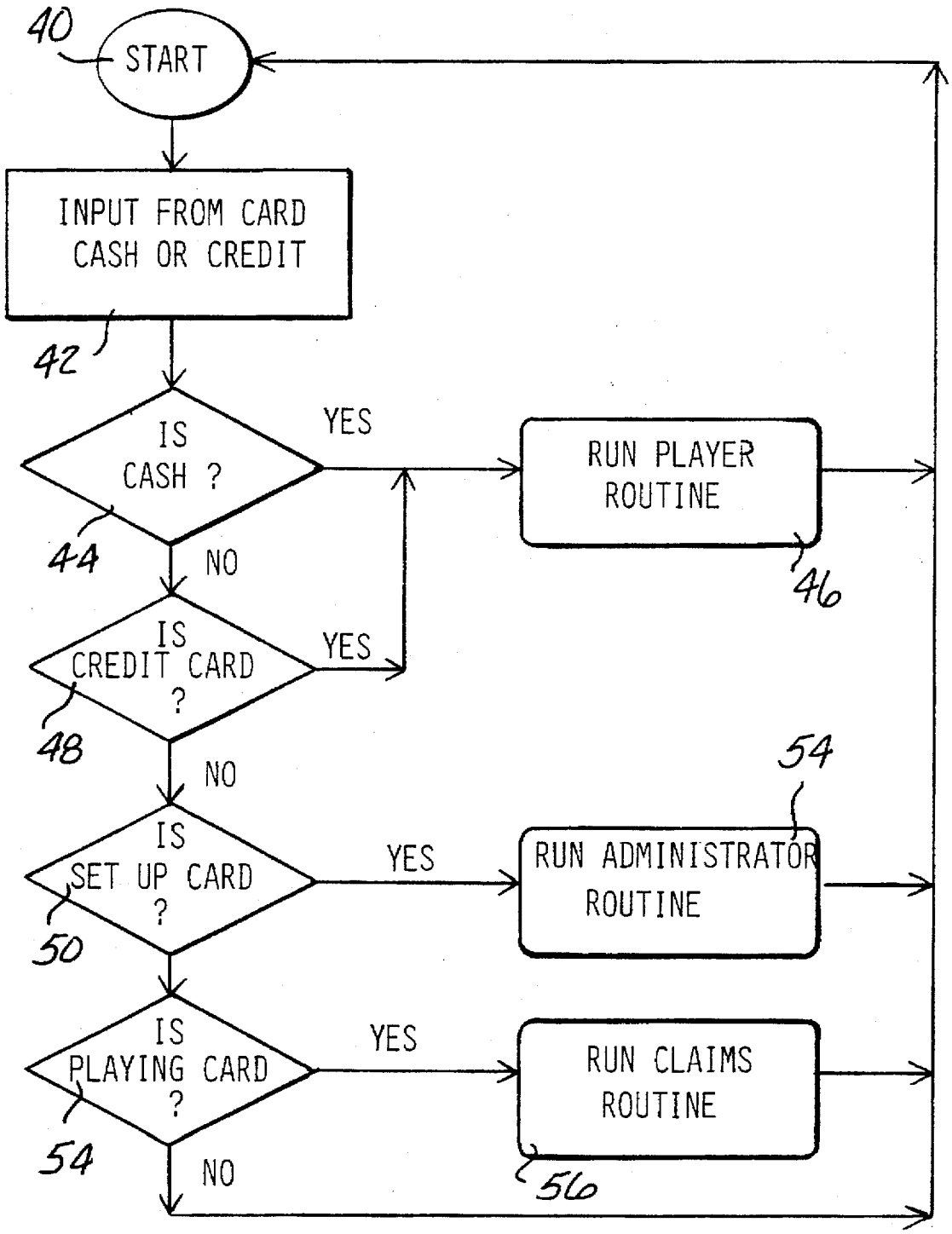
FIG. 4 is a flow chart depicting the sequence of the main control program routine.
Figure 5:
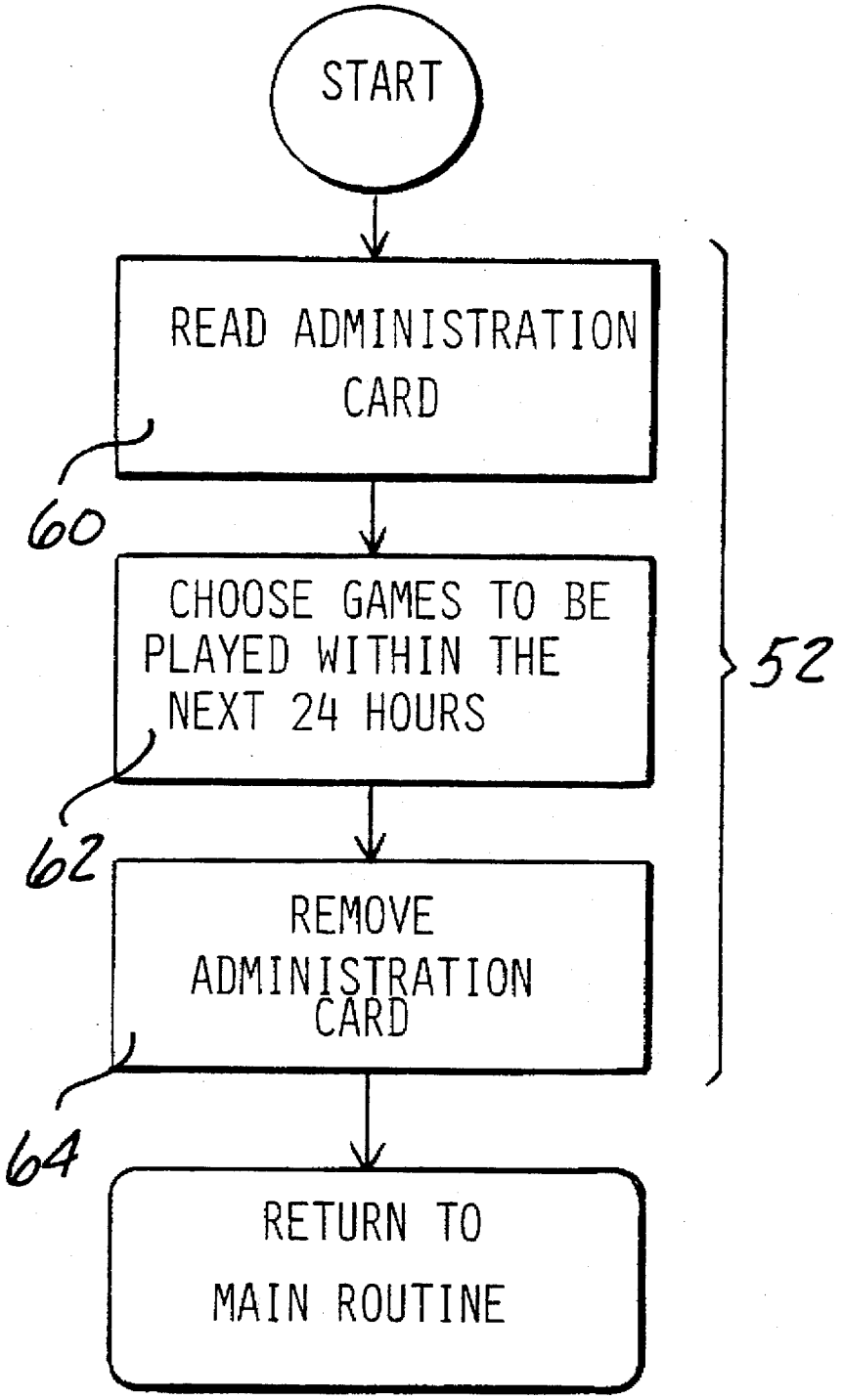
FIG. 5 is a flow chart depicting the sequence of the administration routine.
Figure 7:
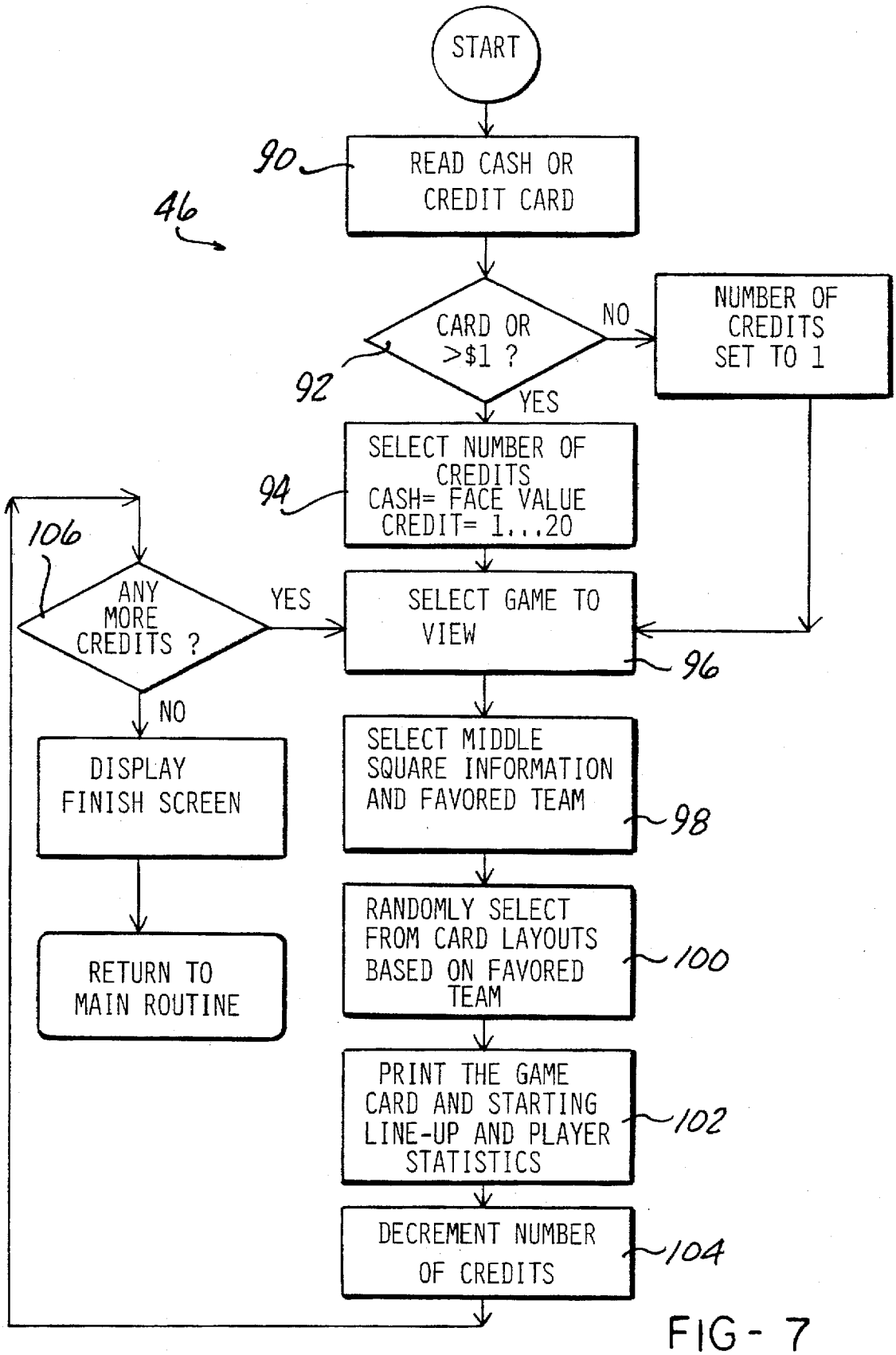
FIG. 7 is a flow chart depicting the game player routine.

Referring now to FIG. 4, there is depicted a main program routine executed by the master computer 12 upon receiving an input from any of the site terminals 22, 24 and 26, etc. After an initial startup in step 40, the master computer 12 recognizes in step 42 an input from a setup card, a previously generated, printed scorecard 30, cash or a credit card. If cash is detected in step 44, the player routine described hereafter in conjunction with FIG. 7 is executed in step 46. If a credit card is detected in step 48, the player routine in step 46 is also executed. A setup card input is detected in step 50 and an administration routine, described hereafter and shown in FIG. 5, is then executed in step 52. Finally, if a scorecard 30 input into one of the site terminals 22, 24, 26 is detected in step 54, a claims routine is executed in step 56.

FIG. 5 depicts the sequence of the administration routine 52. Upon detecting the input of a setup card in step 50 shown in FIG. 4, the administration card is read in step 60, FIG. 5. The administration card includes information specifying the scheduled games between two sports teams in one or more leagues which are to be played within the next 24 hour day as shown in step 62. After input of the game information, the administration card is removed in step 64 and program control returns to the main routine shown in FIG. 4.

Figure 6:
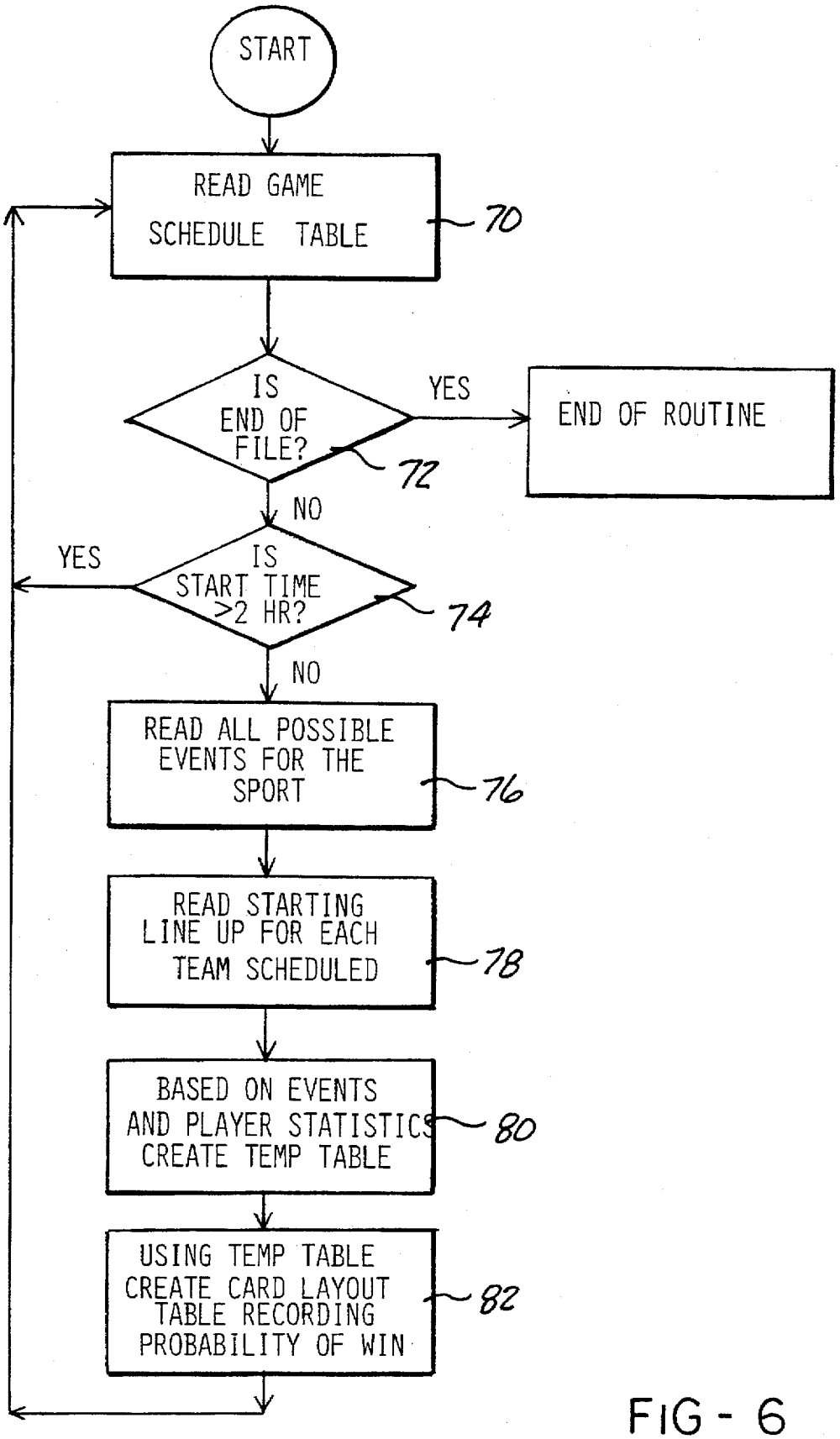
FIG. 6 is a flow chart depicting the card generation routine.

Once each 24 hour day, the master computer 12 reads the game schedule table #5 in response to the scheduled game information within the specified 24 hour period input from the administration card in step 62 as shown in FIG. 5 and described above. The game schedule table #5 is read in step 70, as shown in FIG. 6. For each scheduled game up to the total number of games on a given day, as determined in step 72, the master computer 12 checks if the scheduled sports event starting time is more than two hours away in step 74. If the specified scheduled sports event starting time is more than two hours away, control returns to the reading of the game day schedule table in steps 70 and 72 until the game start time for a specified game is less than two hours away. When this occurs, the master computer 12 in step 76 reads all possible events which can occur for the specified sport from table #2 in step 76. Next, the roster of players available to play for each of the two teams at the specified sports event is read by the master computer 12 from table #6 in step 78. As noted above, the roster of available players for the two teams at a specified sports event has been previously input through the event entry terminal 20 at the specified sports event location. This would preferably happen just prior to two hours before the start of the scheduled sports event.

Next, the master computer 12 according to its control program and based on all possible events which can occur for the specified sport as well as the roster of available players for the two teams at the scheduled sports event and the individual starting player statistics from table #4, generates a TEMP table in step 80. The TEMP table combines the statistics of the players for the two teams contained on the roster of available players at a scheduled sports event with all the possible events which can occur at the sports event and generates a card layout table in step 82 according to specified probability factors of the likely occurrence of any particular event at the sports event that could occur or result from a particular player's activity during the sports event. For example, players on both teams at the specified sports event whose statistics show higher scoring point totals than other players are provided with a larger number of chances or a higher probability that such players would be likely to score a point, goal, etc., during the sporting event than other players who have lower scoring totals, such as defense specific players, for example. Further, players who have a higher incident of penalties can also be marked with a higher probability of being given or responsible for such a penalty. Simply, the TEMP table can associate each starting player on the two specified teams with a predetermined number of chances based on their point, penalty, etc., statistics. The players could simply be ranked according to points scored with the player or players having scored the most points up to date provided with five chances, the next group of lower scoring players with four chances, etc.

Once a specified maximum number of card layouts have been generated in step 82 for one event, the master computer 12 will repeat steps 72–82 for each game layout selected in step 70 until it detects an end of file in step 72 when card layout tables have been generated for each game.

The sports game chance apparatus 10 is now ready for individual player input and the generation of a scorecard for each player according to a player routine executed by the master computer 12 in FIG. 7. A site terminal 22, 24 or 26 will detect and read the input of cash or a credit card in step 90 upon receiving either cash or a credit card through the appropriate slot in each site terminal as shown in FIG. 1. If a credit card or cash in the amount of $1.00 or more, for example only, is read in step 90 and detected in step 92, the master computer 12 selects the number of credits for an individual player. In the case of cash, the number of credits equals the face value of the dollar amount input by the player into a site terminal. In the case of a credit card, the player can input a predetermined number of credits, such as 1, 2, etc., up to a specified maximum, such as 20, for example, to generate one or more scorecards at the player's option. Upon selection of the number of credits in step 94, the master computer 12 then displays on the display at each site terminal a blank scorecard layout in step 96. The master computer 12 then in step 98 selects and prints the indicia or information which is displayed in the free center square 32 on the scorecard 30 as well as randomly selecting a favored team of the two teams scheduled to play the specified sports event. The favored team can be randomly selected between the two scheduled teams or can automatically be the home team.

In step 100, the master computer 12 then randomly selects a number of possible event possibilities from the card layout tables in conjunction with the favorite team selected in step 98. The number of selected possibilities on the scorecard 30 can be higher for the selected favored team than the non-favored team. The master computer 12 then communicates data signals to the site location 22, 24, 26, etc., which received a player input to cause the site location to generate a game scorecard 30 in step 102. The scorecard 30 may also include the starting player lineup and starting player statistics on the back of the card, for example.

The number of credits input in step 94 is then decremented by one in step 104. In step 106, the master computer 12 determines if there are any more credits based on the input from the user in step 94 and if not, displays a "FINISH SCREEN" on the display at the site terminal. Control is then returned to the main routine described above. However, if more credits are available, the master computer 12 then re-executes steps 96, 98, 100, 102 and 104 to generate a plurality of game cards based on the number of credits available to a particular player.

It is envisioned that there will be an established cutoff time at which the master computer 12 will prevent the generation of further scorecards 30 at any of the site terminals 22, 24 and 26. The shutoff time may be the start of the specified sports event or at a predetermined time during the early stages of the event, such as at the end of the first period in the case of a hockey game, etc.

The scorecard 30 can be a hard copy printed card dispensed by a site terminal or a display on a monitor. The specified scorecard arrangement, such as a five×five grid has one possible event occurrence 33 which could occur at the specified sports event printed in each location 31. An example of such event occurrences are shown in FIG. 3 for the scorecard 30. As shown therein, by way of example for a hockey game, individual indicia is printed for each square or individual location 31 on the scorecard 30 listing a particular individual starting player score, an individual starting player penalty, either team total score, a particular penalty by either team, etc. These indicia are selected randomly from the card layout table utilizing a random selection or number generator program in the master computer 12 to generate a distinct scorecard 30. Each scorecard 30 may have a distinct or unique arrangement of individual possible event occurrences, even though certain possible occurrences may be common to any number of scorecards 30. The master computer 12 can be programmed to insure that each scorecard 30 has a distinct arrangement of possible events which could occur during the particular sports event.

As described above, since a higher probability of occurrence of particular events has been pre-established in the TEMP table based on individual player statistics, events which are more apt to occur will be provided with a greater number of chances of being selected for the scorecard 30. Conversely, events with a lesser probability of occurrence can also be provided with a greater number of chances depending on the game administrator's goal for the number of potential winners of the game.

Subsequently, during the sports event, each event occurrence by individual players and/or both teams will be input through the event entry terminal 20 at the arena or stadium in which the specified sports event takes place. This information is then input to the master computer 12.

Figure 8:
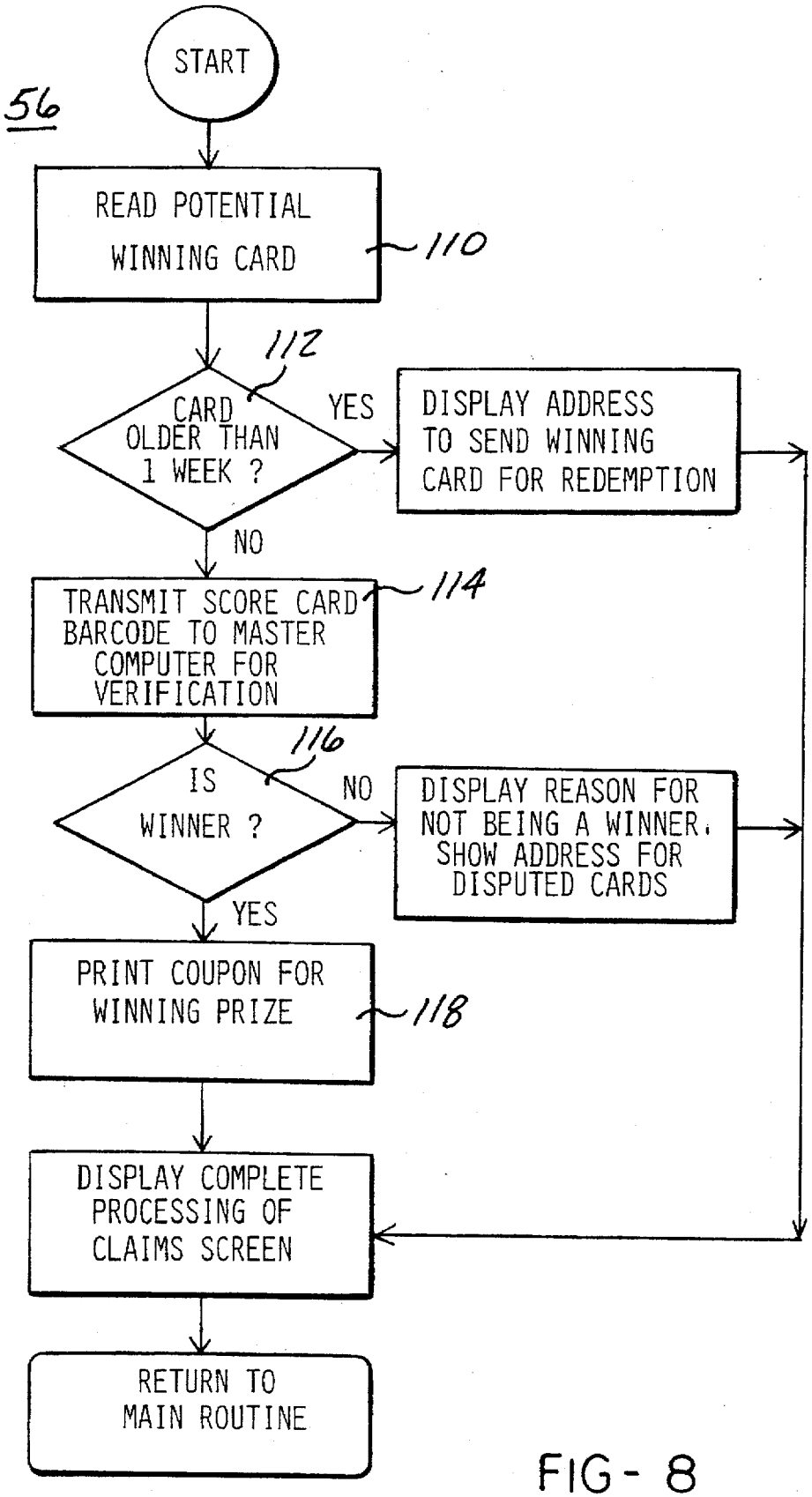
FIG. 8 is a flow chart depicting the claims routine.

At any time during the sports event or preferably at the completion of the sports event, a player having a scorecard 30 may insert the scorecard 30 into one of the site terminals 22, 24, 26, etc. This causes the claims routine to be selected in step 56 of the main routine shown in FIG. 4 and described above. The detailed sequence of the claims routine is shown in FIG. 8.

The site terminal, such as site terminal 22 for example, reads the scorecard 30 input thereto in step 110. If the scorecard 30 carries a date more than one week after the completion of the specified sports event, the site terminal 22 in step 112 will display an address to which the player can send the winning scorecard 30 for redemption if the scorecard 30 is determined to be a winner.

If less than a week has transpired from the completion of the specified sports event, the site terminal 22 transmits the scorecard identification, such as the scorecard barcode, to the master computer 12 for verification in step 114.

The master computer 12 using the transmitted scorecard identification or barcode accesses table number 9 in the database which contains all of the selected possible event occurrences and their location on the identified scorecard. This information is compared with the actual event occurrences at the specified sports event contained in table number 7. The master computer 12 then determines in step 116 if the particular scorecard is a "winner". If it is not a winner, the master computer 12 generates appropriate control signals to the site terminal 22 which causes a message to be displayed indicating that the scorecard is not a winner. A particular reason for a non-winning scorecard may be displayed as well as an address for use by a player in the event of a disputed winner/non-winner decision.

According to the present invention, a winning scorecard 30 can be determined in one of many different ways. In the case of the five×five grid shown on the scorecard 30 in FIG. 3, matches between possible event occurrences on the card 30 and actual event occurrences which took place at the specified sports event arranged in five horizontal, vertical or diagonal rows on the card 30 denotes a winner. Alternately, the individual locations 31 on a scorecard 30 may be provided with an individual point total which can be used to determine a winning card based on matching locations whose total points exceed a predetermined number. Various point totals may be provided to determine winning cards, with different point totals specifying a particular prize to be awarded to the player.

In addition to rows denoting a winning card, a particular arrangement of matched locations, such as four corners or any other pattern on a card 30 may be utilized to determine a winner. The individual locations may also be provided in various colors with or without distinct points assigned to each location 31.

If a winning card is determined in step 116, the master computer 12 transmits information to the site terminal which displays a notification of a winning card as well the particular prize which the player has won. The site terminal will preferably print a certificate or other award indicating a winning card and the prize won which the player can redeem at an appropriate location at the arena or by mail to a specified address on the certificate.

As the sports chance game of the present invention is intended to increase fan enthusiasm and interest in the scheduled sports events, it is preferred that the probability of matches between possible events printed on each scorecard 30 with the probability of such events actually occurring be increased to provide a large number of winning scorecards 30. Of course, this can be adjusted for even higher or lower numbers of winning scorecards on a league wide basis or differently for each scheduled event, arena, etc.

In summary, there has been described a unique sports chance game apparatus and method of playing the same which is both easy to use and is applicable to many different organized sports. The apparatus and method is usable in many different arrangements covering multiple leagues of sports teams playing different sports as well as on a single league basis, or even only in a specific arena or stadium involving sports events involving one team. The sports chance game apparatus and method of the present invention provides an easy means to increase fan enthusiasm and interest in a sports event by combining chance with actual events which take place during the sports event, which factors may be selected in varying degrees of probability to vary the number of "winners" of the game. The present sports chance game apparatus is also amenable to play directly in an arena in which a particular sports event is contested as well as at locations remote from sports arenas and even over an interactive television/cable system for play in homes and other establishments.

What is claimed is:

1. A method of playing a game of chance comprising the steps of:

selecting two named teams, each having a plurality of individual players, who are competing in a sports event;

establishing a first set of possible occurrences which occur at the sports event between the two teams, the possible occurrences which occur during the sports event including at least one of:

scores under rules of the sporting event by individual identified players on each team;

a score under the rules of the sporting event by each team;

penalties under the rules of the sporting event by each team; and penalties under the rules of the sporting event by individual identified players on each team;

verifying a user to play the game;

upon verifying a user, randomly selecting a second set of occurrences from the first set of occurrences, the second set of occurrences containing fewer occurrences than a total number of occurrences in the first set;

tabulating statistics for each player on each of the two teams from previous sports events played by each player;

increasing the probability that certain occurrences of the second set of occurrences by certain players on each team are selected based on individual player statistics;

establishing a layout having a plurality of individual locations adapted for association with one of the second set of occurrences;

randomly assigning each of the second set of occurrences to one of the individual locations on the layout;

determining actual occurrences at the sports event; and verifying a winning layout which has one of a predetermined number of matches and a predetermined number of matches arranged in a defined pattern on the layout wherein a match is determined by one of the second set of occurrences matching one of the actual occurrences at the sports event.

2. The method of claim 1 wherein the step of establishing the first set of occurrences further comprises the step of:

selecting possible occurrences at the sports event for the first set of possible occurrences by selected ones of the players on each team less than a total number of players on each team.

3. The method of claim 1 wherein the step of selecting two teams further comprises the step of:

selecting two teams which meet at a set date from a plurality of teams playing other teams in a set schedule.

4. The method of claim 1 wherein:

scores under the rules of the sporting event by individual players on each team include scores in one of defined, discrete segments of the sporting event.

5. The method of claim 1 further comprising the step of:

assigning different point values to the individual locations on the layout; and wherein the step of verifying a winning layout is determined by accumulated point values of matches of individual locations on the layout and actual event occurrences at the sporting event exceeding a preset total.

6. The method of claim 1 wherein the step of establishing a layout of individual locations comprises the step of:

printing a layout of individual locations on a card.

7. The method of claim 1 wherein the step of establishing a layout of individual locations comprises the step of:

arranging the individual locations in a grid wherein each individual location is in registry with at least one other individual location.

8. The method of claim 7 wherein the step of establishing a layout of individual locations comprises the steps of:

arranging the plurality of individual locations into an n×n grid, where n is an integer greater than one.

9. The method of claim 8 wherein the step of verifying a winning layout comprises the step of:

determining n matches between the second occurrences assigned to each of the plurality of individual locations on the grid and the actual occurrences at the sport event wherein the n matches are arranged in a row having a length of n locations.

10. The method of claim 1 further comprising the step of:

establishing the names of players on each of the two teams meeting in a sports event who are available to play in the sports event.

11. An apparatus for playing a sport chance game in response to actual event occurrences at a sports event contested by two teams, the apparatus comprising:

memory means for storing a control program and data representing names of two teams contesting a sports event, names of players on the two teams, and a first group of a plurality of different possible events which occur at the sports event, the first group of possible events including at least one of:

scores under rules of the sporting event by individual identified players on each team;

a score under the rules of the sporting event by each team;

penalties under the rules of the sporting event by each team; and penalties under the rules of the sporting event by individual identified players on each team;

processor means, executing the control program stored in the memory means and responsive to the data stored in the memory means, for randomly selecting a second group of a plurality of events from the first group of events which occur at the sports event;

means for tabulating statistics for each player on each of the two teams from previous sports events played by each player;

means, responsive to means for tabulating statistics, for increasing the probability that certain occurrences of the second set of occurrences by certain players on each team are selected based on individual player statistics;

the processor means randomly arranging each of the plurality of events in the second group of events in one location on a scorecard having a patterned arrangement of a plurality of individual locations;

means for verifying a user to obtain a scorecard;

means for inputting actual event occurrences at the sporting event to the processor means; and the processor means, responsive to the inputting means, for determining matches between the second group of possible occurrences on the scorecard with actual event occurrences at the sporting event and determining a winning scorecard according to defined rules.

12. The apparatus of claim 11 wherein:

the memory means stores the names of all teams in a league and two teams of all of the teams meeting in a sports event according to a defined schedule.

13. The apparatus of claim 11 further comprising:

means for inputting to the processor means the names of players on each of the two teams meeting in a sports event who are available to play in the sports event.

14. The apparatus of claim 11 wherein the scorecard comprises:

an n×n grid of locations, where n is an integer greater than one.

15. The apparatus of claim 14 wherein:

the processor means determines a winning scorecard by a defined number of matches in a row on the card.

16. The apparatus of claim 11 further comprising:

means, responsive to the processor means, for printing randomly arranged second group of possible occurrences at the sporting event on the scorecard; and means for delivering the scorecard to a verified user.

17. The apparatus of claim 11 further comprising:

means, responsive to the processor means, for visually displaying the patterned arrangement of selected ones of the second group of possible occurrences at the sports event.

18. The apparatus of claim 11 wherein the processor means comprises:

a central processing unit connected in data communication with the memory means; and the means for verifying a user includes terminal means having means for receiving and determining the amount of currency input by a user.

19. The apparatus of claim 18 further comprising:

a plurality of terminal means, each remotely located from and connected in data communication with the processor means.

20. The apparatus of claim 11 wherein:

the processor means stores the selected ones of the first group of possible occurrences in the randomly generated pattern for each scorecard in the memory means.

21. The apparatus of claim 20 further comprising:

unique identification means assigned to each scorecard.

22. The apparatus of claim 21 further comprising:

means, responsive to the processor means, for printing the pattern of selected ones of the second group of possible occurrences at the sporting events on the scorecard; and means for receiving a printed card from a user; and means, responsive to the printed card receiving means, for determining the unique identification means of the card.

23. The apparatus of claim 22 wherein:

the processor means is responsive to the means for determining the unique identification means of the card for determining matches on the card by recalling the location of the second group of possible occurrences selected for an identified card input to the card receiving means with the actual events which occurred at the sports event.

* * * * *